US007473191B2

(12) United States Patent
Yokota

(10) Patent No.: US 7,473,191 B2
(45) Date of Patent: Jan. 6, 2009

(54) GOLF CLUB HEAD

(75) Inventor: Masatoshi Yokota, Kobe (JP)

(73) Assignee: SRI Sports Limited, Kobe-shi, Hyogo-ken (JP)

( * ) Notice: Subject to any disclaimer, the term of this patent is extended or adjusted under 35 U.S.C. 154(b) by 163 days.

(21) Appl. No.: 11/495,746

(22) Filed: Jul. 31, 2006

(65) Prior Publication Data

US 2007/0049412 A1 Mar. 1, 2007

(30) Foreign Application Priority Data

Aug. 23, 2005 (JP) ..... 2005-241755

(51) Int. Cl.
*A63B 53/04* (2006.01)

(52) U.S. Cl. ..... 473/345; 473/348

(58) Field of Classification Search ..... None
See application file for complete search history.

(56) References Cited

U.S. PATENT DOCUMENTS

2007/0049406 A1* 3/2007 Tateno et al. ..... 473/345
2007/0049407 A1* 3/2007 Tateno et al. ..... 473/345

FOREIGN PATENT DOCUMENTS

JP 07284546 A * 10/1995
JP 10085369 A 4/1998
JP 2000300701 A * 10/2000

* cited by examiner

*Primary Examiner*—Eugene Kim
*Assistant Examiner*—Alvin A Hunter
(74) *Attorney, Agent, or Firm*—Birch, Stewart, Kolasch and Birch, LLP

(57) ABSTRACT

A hollow golf club head comprises: a face portion; a crown portion; a sole portion; and a side portion between the crown portion and sole portion, extending from a toe-side edge to a heel-side edge of the club face through the back face of the head. The crown portion is provided with a thickness-reduced part having a thickness of from 0.4 to 0.7 mm. The side portion is provided with: at least two vertical buttressed parts each extending from the crown portion to the sole portion and having a thickness of more than 0.6 mm but not more than 2.0 mm; and a thin part formed between the vertical buttressed parts and having a thickness of not more than 0.6 mm.

5 Claims, 9 Drawing Sheets

GOLF CLUB HEAD

BACKGROUND OF THE INVENTION

The present invention relates to a golf club head, more particularly to an improved structure of the side portion of a hollow golf club head.

In recent years, there is a trend toward large-sized golf club heads. As a result of development of metal materials and improvements in the manufacturing techniques, wood-type hollow heads having a head volume of over 400 cc have been placed on the market.

In general, with the increase in the head volume, the height of the center of gravity is increased. In the case of large-sized golf club heads, therefore, it becomes necessary to relatively increase the weight in the sole portion in order to prevent the high center of gravity. However, in view of the swing balance and the like, the maximum weight of the head is limited. Accordingly, it is necessary to increase the margin of weight in other portions than the sole portion so that the weight can be increased in the sole portion.

If a lightweight fiber reinforced plastic is used in the crown portion, the weight margin can be increased in the crown portion. But, such a fiber reinforced plastic has a relatively large internal loss when compared with metal materials. Therefore, there is a tendency that the ball hit sound becomes dull. Further, there is a tendency that the hit feeling becomes bad since the response received by the player's hands at impact is reduced.

SUMMARY OF THE INVENTION

It is therefore, an object of the present invention to provide a golf club head, in which the weight margin is increased to increase the design freedom of the center of gravity, without deteriorating the hit feeling.

According to the present invention, a hollow golf club head comprises a face portion having a club face, a crown portion, a sole portion, and a side portion between the crown portion and sole portion, extending from a toe-side edge to a heel-side edge of the club face through the back face of the head, wherein the crown portion is provided with a part having a thickness of from 0.4 to 0.7 mm, and the side portion is provided with at least two vertical buttressed parts each extending from the crown portion to the sole portion, and having a thickness of more than 0.6 mm but not more than 2.0 mm and at least one thin part having a thickness of not more than 0.6 mm and formed between the vertical buttressed parts.

DESCRIPTION OF THE PREFERRED EMBODIMENTS

Embodiments of the present invention will now be described in detail in conjunction with the accompanying drawings.

Figure 1:
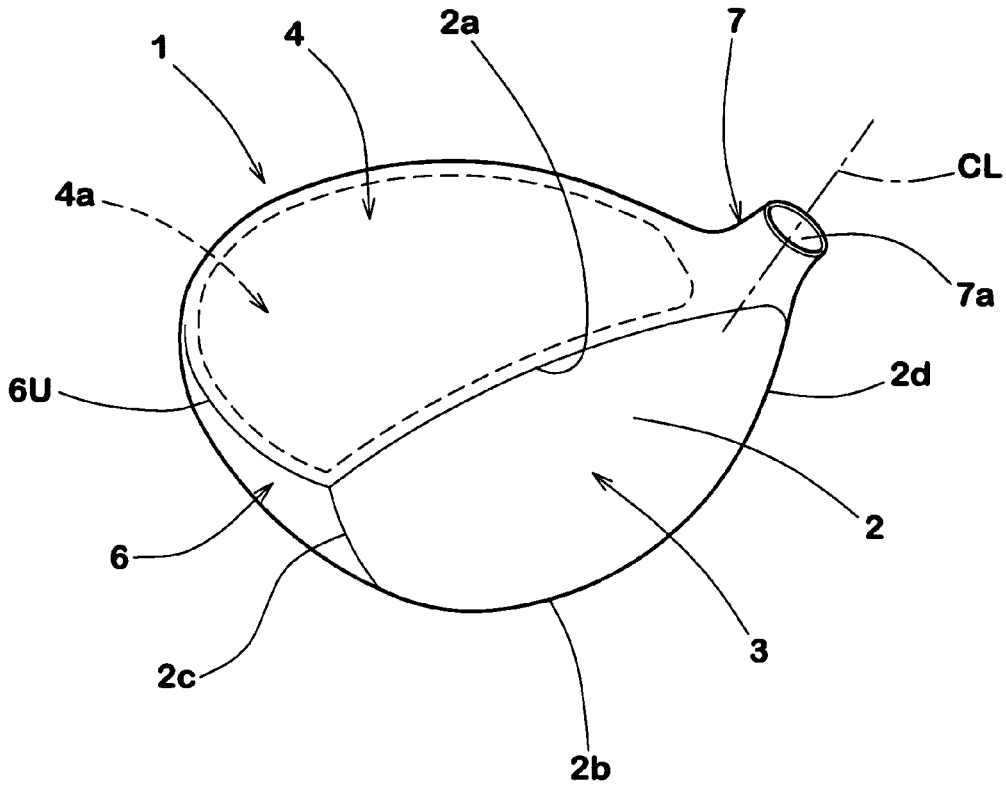
FIG. 1 is a perspective view of a wood-type golf club head according to the present invention.
Figure 2:
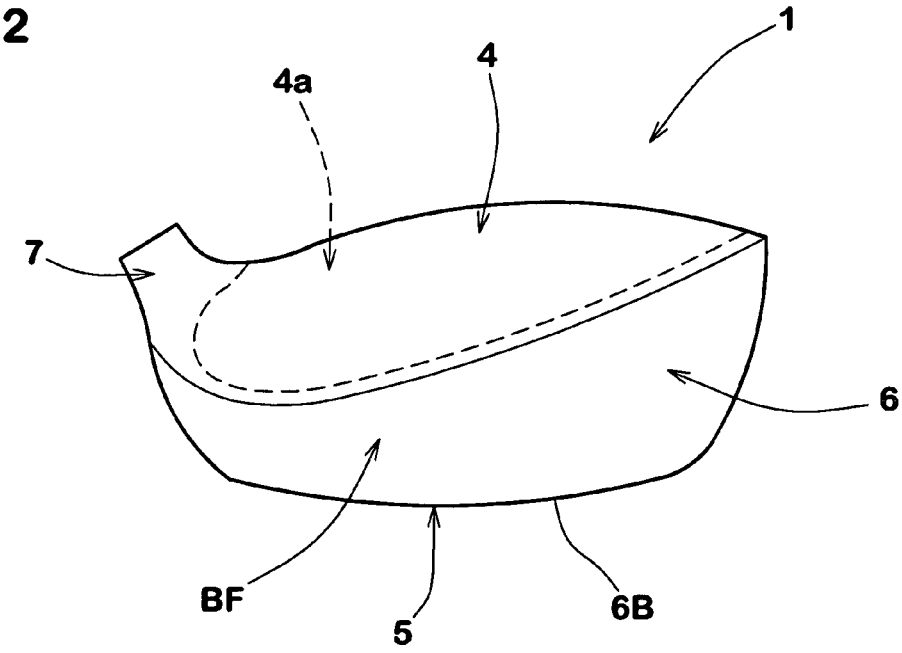
FIG. 2 is a rear view thereof.
Figure 3:
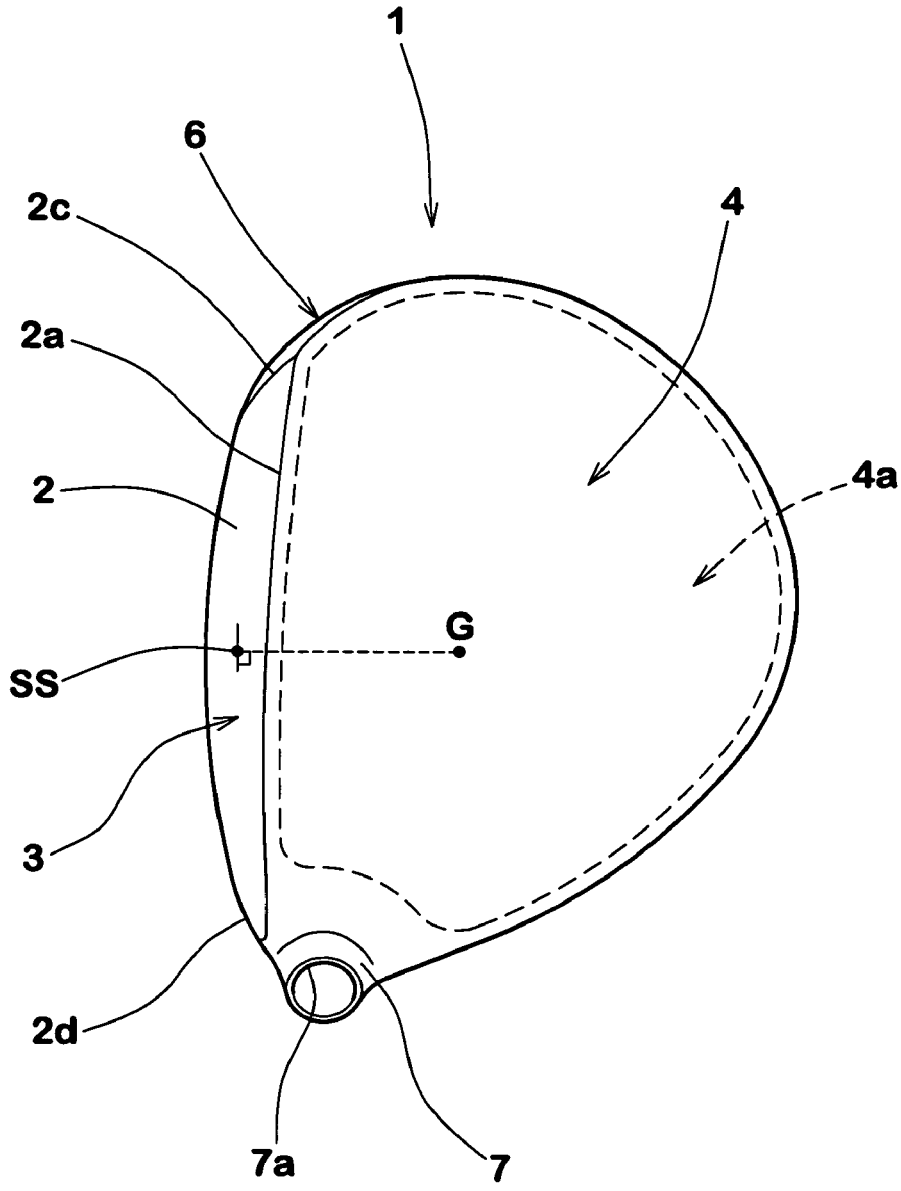
FIG. 3 is a top view thereof.

In the drawings, golf club head 1 according to the present invention is a wood-type hollow head which as shown in FIGS. 1-3 comprises: a face portion 3 whose front face defines a club face 2 for striking a ball and rear face faces a hollow (i); a crown portion 4 intersecting the club face 2 at the upper edge 2*a* thereof; a sole portion 5 intersecting the club face 2 at the lower edge 2*b* thereof; a side portion 6 between the crown portion 4 and sole portion 5 which extends from a toe-side edge 2*c* to a heel-side edge 2*d* of the club face 2 through the back face BF of the club head; and a hosel portion 7 to be attached to an end of a club shaft (not shown). The hosel portion 7 protrudes upwardly from the heel-side end of the crown portion 3, and a shaft inserting hole 7*a* is opened at the upper end thereof.

The head 1 preferably has a volume of at least 300 cc, more preferably more than 320 cc, still more preferably more than 350 cc, yet still more preferably more than 400 cc, most preferably more than 420 cc, whereby the moment of inertia of the head 1 becomes increased, and movement of the head at miss shots becomes decreased to improve the directional stability. On the other hand, if the head volume is too large, it becomes difficult to avoid: deterioration of swing balance and lowering of the head speed owing to a resultant head weight increase; or deterioration of durability owing to thinning of head components for the purpose of avoiding the undesirable head weight increase. From such a point of view, the head volume is preferably at most 500 cc, more preferably less than 470 cc. The present invention can be suitable applied to such a large-sized hollow head.

The crown portion 4 has a thickness tc decreased to 0.7 mm or less in the almost entire part 4*a* excluding the peripheral part near the face portion 3, side portion 6 and hosel portion 7. But, if the thickness tc is decreased to less than 0.4 mm, it becomes very difficult to secure necessary durability. Therefore, the thickness tc is at lest 0.4 mm. The reason for retaining the thickness of the peripheral part is to make this thick part as a frame work to provide a strength. This is however, not indispensable. The entirety of the crown portion may be decreased in the thickness.

In order to reduce the weight as much as possible by decreasing the thickness tc, the area of this decreased-thickness part 4*a* is at least 50%, preferably more than 70%, more preferably more than 90% of the area of the crown portion 4 inclusive of the hosel portion 7, wherein each area is the project area to a horizontal plane under the standard state of the head.

The standard state is such that the head 1 is set on a horizontal plane so that the center line CL of the club shaft (or the shaft inserting hole) is inclined at its lie angle while keeping the center line CL on a vertical plane, and the club face forms its loft angle with respect to the horizontal plane.

Figure 4:
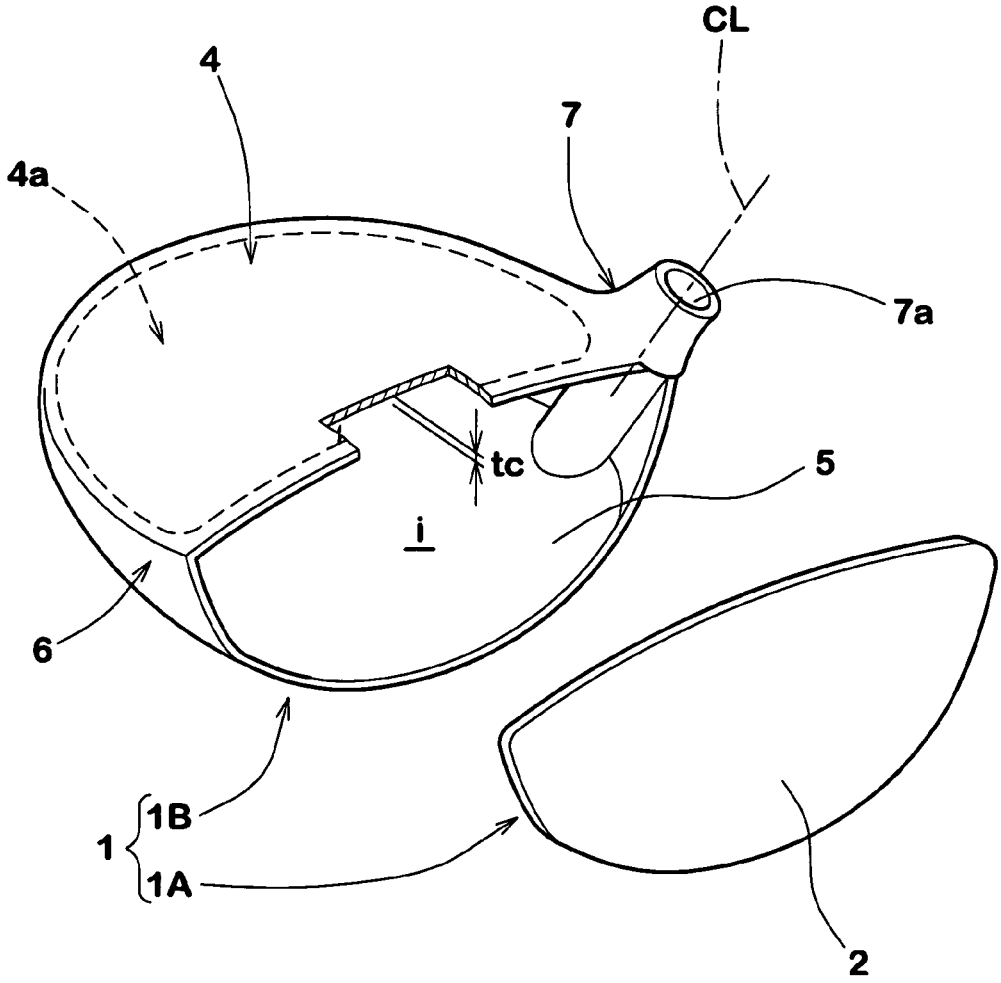
FIG. 4 is a perspective view showing a two-piece structure which can be adopted to make the golf club head according to the present invention.

FIG. 4 shows a two-piece structure which can be suitably adopted in the golf club head 1.

Figure 5:
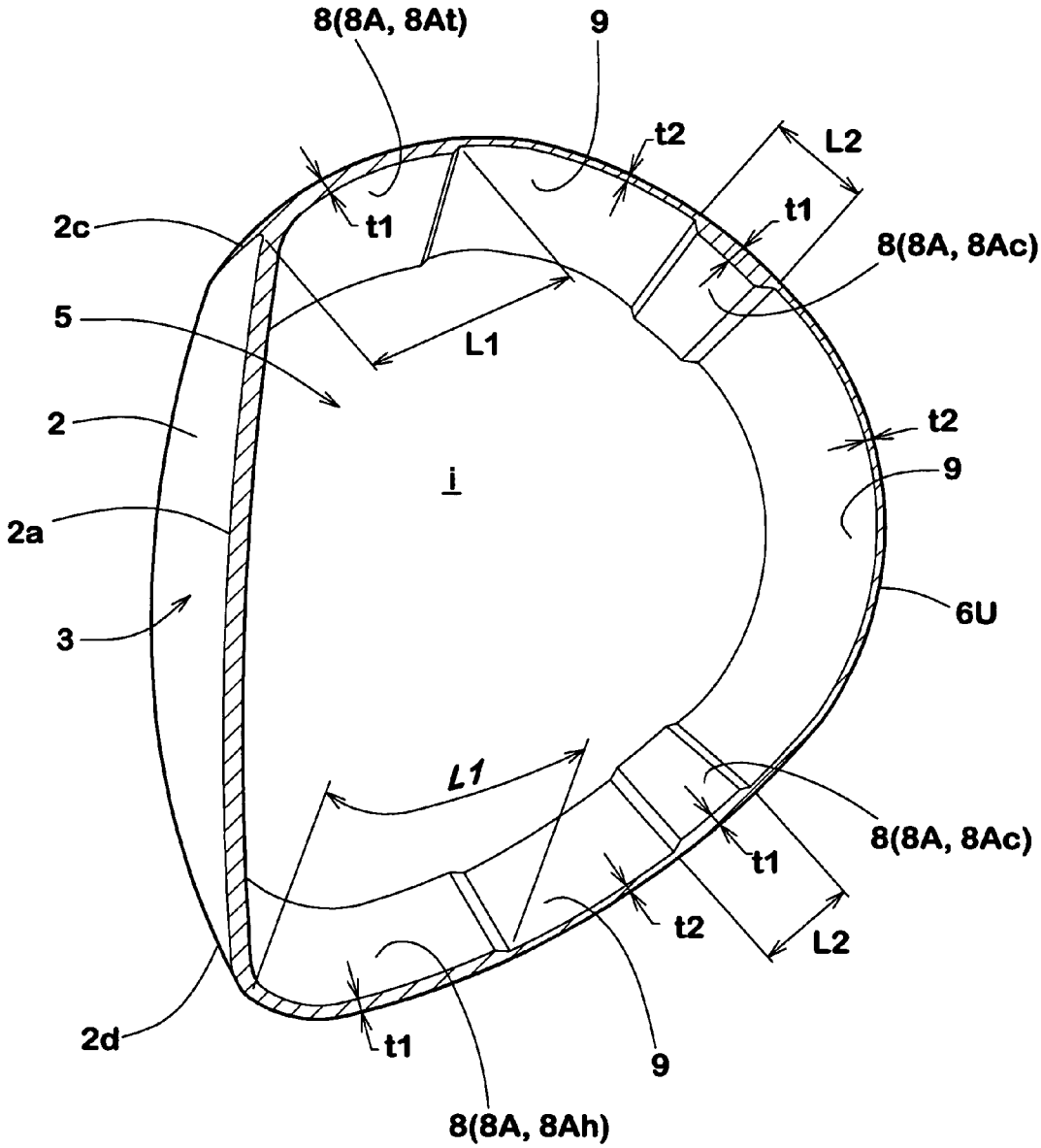
FIG. 5 is an overhead view of an example of the side portion of the golf club head in which the crown portion is cut away along a cutting plane positioned at the upper edges of the club face and the side portion.
Figure 6:
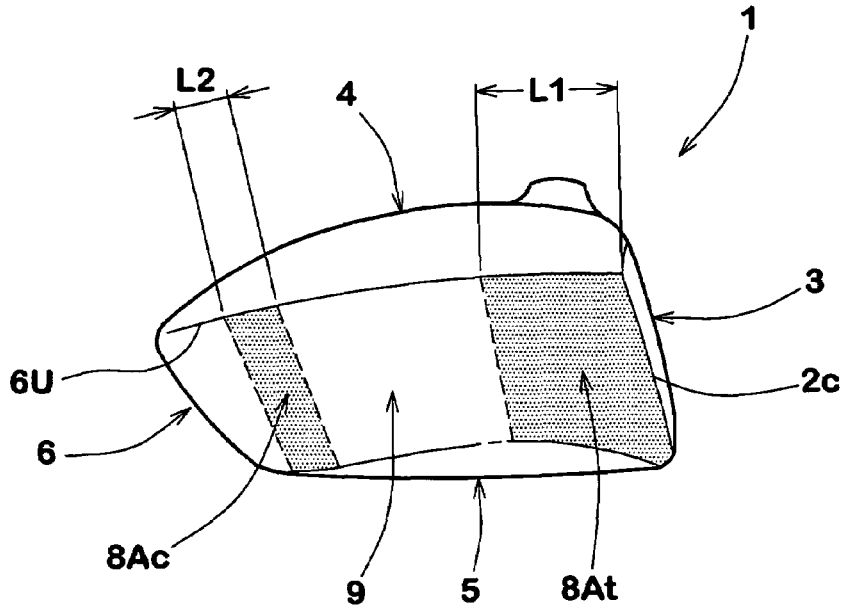
FIG. 6 is a left side view of the side portion shown in FIG. 5.
Figure 7:
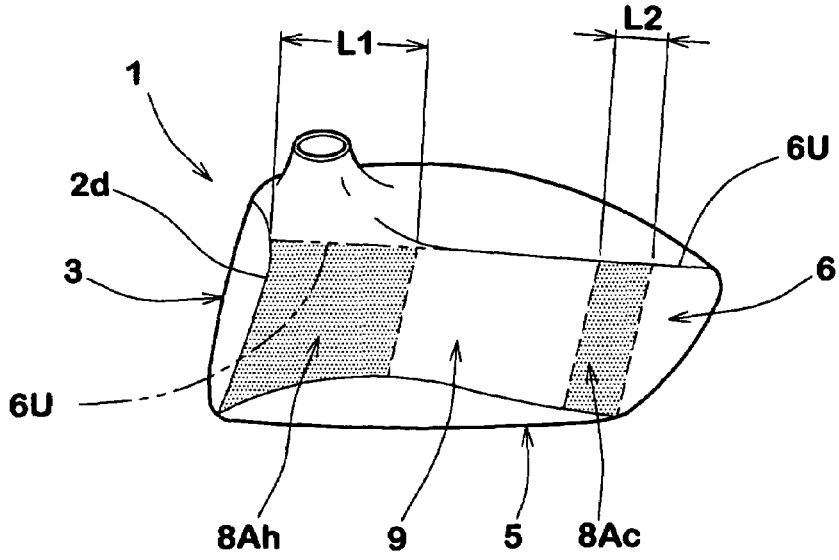
FIG. 7 is a right side view of the side portion shown in FIG. 5.

FIGS. 5, 6 and 7 show a structure of the side portion 5 suitably combined with the two-piece structure although it can be combined with the undermentioned four-piece structure.

Figure 8:
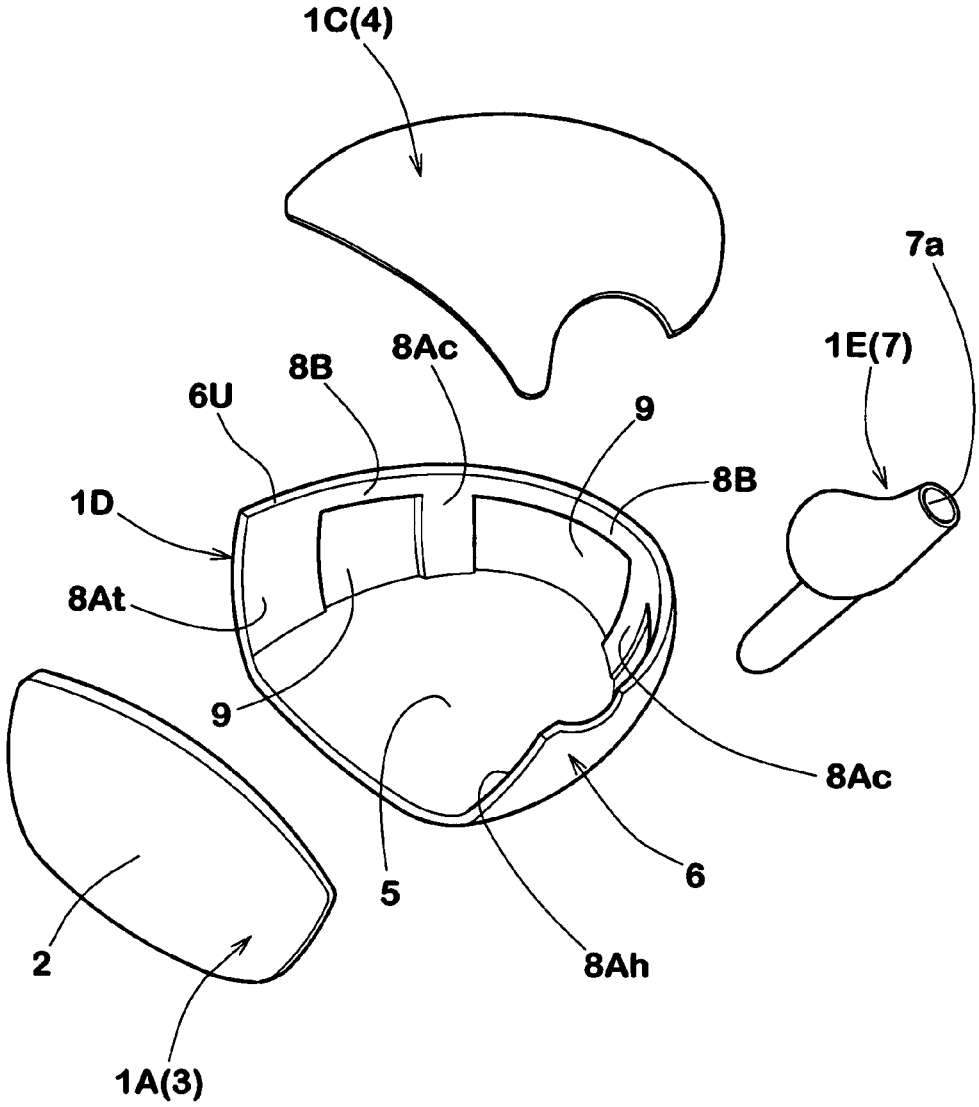
FIG. 8 is a perspective view showing a four-piece structure which can be adopted to make the golf club head according to the present invention.

FIG. 8 shows a four-piece structure which can be suitably adopted in the golf club head 1.

Figure 9:
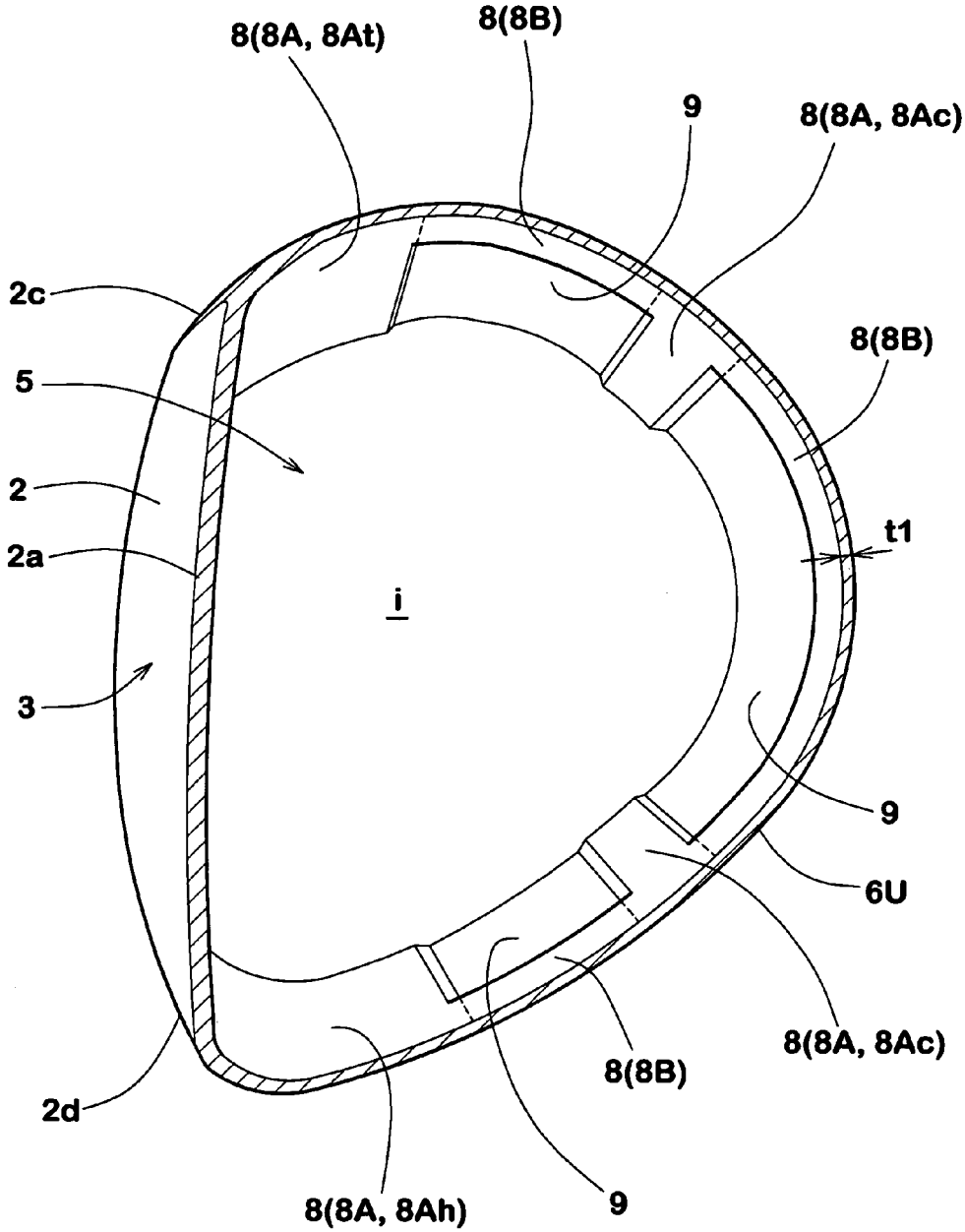
FIG. 9 is an overhead view of another example of the side portion of the golf club head in which the crown portion is cut away along a cutting plane positioned at the upper edges of the club face and the side portion.
Figure 10:
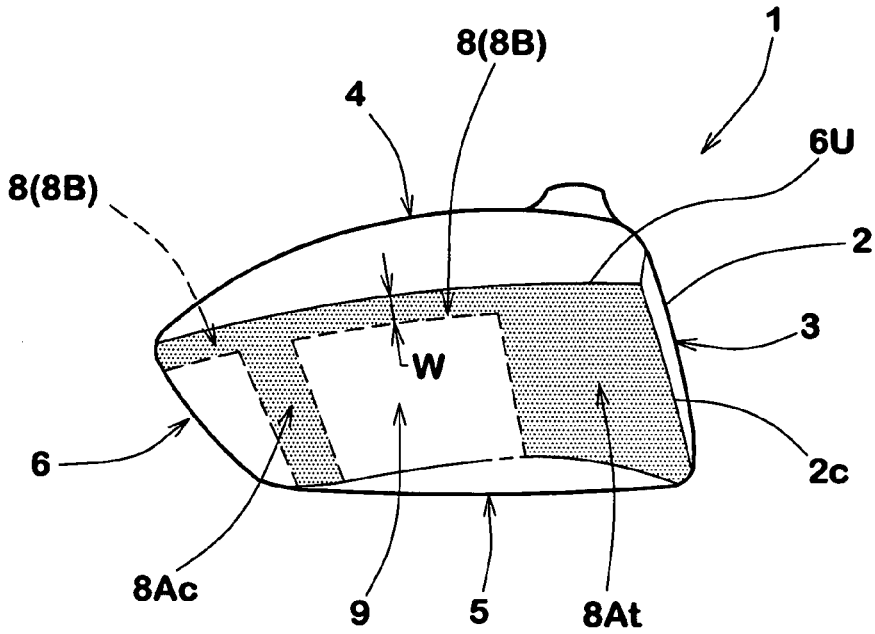
FIG. 10 is a left side view of the side portion shown in FIG. 9.
Figure 11:
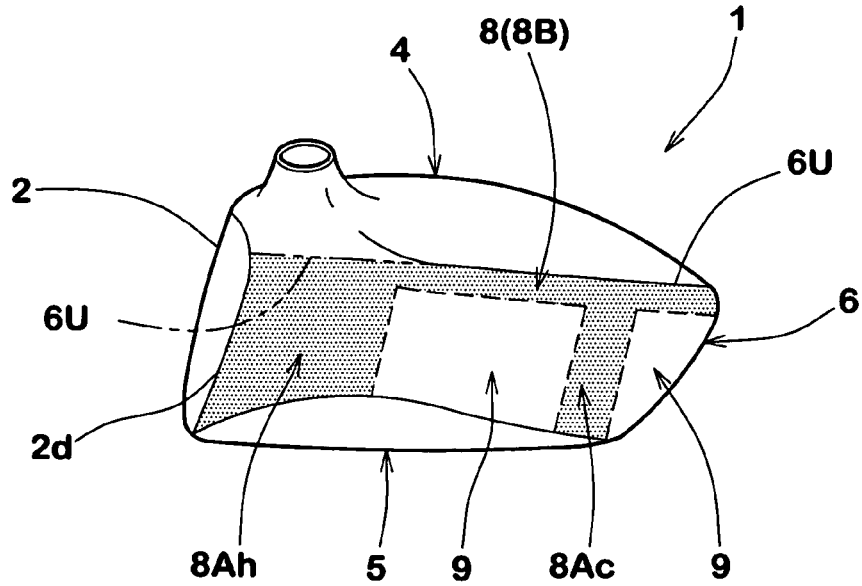
FIG. 11 is a right side view of the side portion shown in FIG. 9.

FIGS. 9, 10 and 11 show another structure of the side portion 5 suitably combined with the four-piece structure although it can be combined with the above two-piece structure.

The two-piece structure is made up of two metal parts welded each other, namely, a face member 1A and a head main body 1B. The face member 1A is a metal plate forming a major part (in this example the entirety) of the club face 2. The head main body 1B is an open-front shell construction which forms the crown portion 4, sole portion 5, side portion 6 and hosel portion 7. The face member 1A is attached at the front thereof.

The four-piece structure is made up of four metal parts welded each other, namely, a face member 1A, a crown member 1C, a sole-and-side member 1D, and a hosel member 1E. The face member 1A is similar to that of the two-piece structure. The crown member 1C is a curved plate forming a major part (in this example the entirety) of the crown portion 4. The sole-and-side member 1D forms at least a major part (in this example the entirety) of the sole portion 5 and at least a major part (in this example the entirety) of side portion 6. The hosel member 1E forms the hosel portion 7. These members can be manufactured by forging.

According to the present invention, the side portion 6 comprises thin parts 9 decreased in the thickness and relatively thick buttressed parts 8.

If the thin parts 9 are increased in the total percentage, the deformation of the club head at impact tends to increase, and the hit feeling becomes soft. If the total percentage is decreased contrary, the hit feeling becomes hard. Thus, by changing the total percentage, the rigidity of the side portion 6 can be adjusted in order to improve the hit feeling.

However, if the thin part 9 is too thin, it is difficult to provide a necessary strength. Therefor, the thickness t2 of the thin part 9 is not less than 0.3 mm, preferably not less than 0.35 mm, more preferably not less than 0.4 mm, but not more than 0.6 mm, preferably not more than 0.55 mm, more preferably not more than 0.5 mm.

The buttressed parts 8 includes at least two, preferably three or four vertical buttressed parts 8A each extending from the crown portion 4 to sole portion 5. Accordingly, at least one, preferably two or three thin parts 9 are formed between the vertical buttressed parts 8A.

If the thickness t1 of the buttressed part 8 exceeds 2.0 mm, the hit feeling tends to become excessively hard. The center of gravity tends to become higher.

If the thickness t1 becomes less than 0.6 mm, the strength of the side portion 6 as whole decreases and the durability is lowered. It becomes difficult to obtain a solid hit feeling. Therefore, the thickness t1 of the buttressed part 8 is not more than 2.0 mm, preferably not more than 1.8 mm, more preferably not more than 1.6 mm, but not less than 0.6 mm, preferably not less than 0.7 mm, more preferably not less than 0.8 mm.

In order that a sufficient weight margin usable in the sole portion 5 can be obtained from the side portion 6, the difference (t1−t2) between the thickness t2 of each thin part 9 and the thickness t1 of one of, preferably each of the adjacent two vertical buttressed parts 8A is not less than 0.2 mm, preferably not less than 0.3 mm, more preferably not less than 0.4 mm. However, if the difference (t1−t2) becomes too large, a stress concentration at the boundary becomes not negligible. Therefore, the difference is not more than 1.5 mm, preferably not more than 1.0 mm.

Here, the thicknesses t1 and t2 are measured perpendicularly to the outer surface of the side portion 6.

Due to the buttressed parts 8, the inner surface is uneven, but the outer surface of the side portion 6 is even. It is preferable that from the thin part 9 to the buttressed part 8, the thickness is smoothly continuously varied in order to avoid stress concentration.

In any plane parallel with the above-mentioned horizontal plane, a width measured along the inner surface of the vertical buttressed part 8A is more than 1 mm, preferably more than 5 mm, more preferably more than 8 mm, but preferably not more than 50 mm, more preferably not more than 40 mm. In the illustrated examples, such width is substantially constant along the vertical direction, but it is also possible to vary the width. For example, by gradually increasing the width towards the sole portion 5, the center of gravity of the head can be lowered.

Preferably, the vertical buttressed parts 8A include a toe-side vertical buttressed part 8At and a heel-side vertical buttressed part 8Ah which have a larger width, and at least one, preferably two or three vertical buttressed part 8Ac therebetween which have a smaller width.

The front ends of the side portion 6 to which the face portion 3 is attached are subjected to a large impact force when striking a ball and a large stress is caused. Therefore, the strength of the front end portion largely affects the durability of the head. The rigidity of the front end portion has a great effect on hit feeling. Therefore, in order to control the deformation at impact to provide excellent hit feeling and durability, the toe-side vertical buttressed part 8At is extended to the front end so as to come into contact with the toe-side edge 2*c* of the club face 2, and the heel-side vertical buttressed part 8Ah is extended to the front end so as to come into contact with the heel-side edge 2*d*.

The two in-between vertical buttressed parts 8Ac are disposed toward the toe-side and heel-side edges respectively to provide in the back face area with a relatively wide thin part 9 having a horizontal length of not less than 80 mm therealong, whereby it becomes possible to further improve the durability and hit feeling. Further, advantageously, the weight distribution can be shifted towards the toe and heel, and the moment of inertia of the club head 1 is increased to improve the directional stability.

As to the size of the toe-side and heel-side vertical buttressed parts 8At and 8Ah, when measured along the upper edge of the side portion 6, it is preferable that each part has a length L1 of not less than 5 mm, preferably not less than 7 mm, more preferably not less than 8 mm, but not more than 50 mm, preferably not more than 40 mm, more preferably not more than 30 mm.

If the length L1 is less than 5 mm, due to the increased deformation at impact, the hit feeling and durability tends to deteriorate. If more than 50 mm, there is a tendency toward the high center of gravity.

In each of the vertical buttressed parts 8At and 8Ah, the above-mentioned length L1 is substantially maintained from the crown portion 4 to the sole portion 5 in this example.

The length L2 of each of the in-between vertical buttressed parts 8Ac measured along the upper edge 6U of the side portion is not less than 1 mm, preferably not less than 3 mm, but not more than 10 mm, preferably not more than 8 mm, and less than the length L1 of either of the toe-side and heel-side vertical buttressed parts 8At and 8Ah.

If the length L2 is more than the length L1 or more than 10 mm, the rigidity of the side portion 6 is excessively increased, and the hit feeling tends to become hard, and the center of gravity of the head 1 tend to become higher. If the length L2 is less than 1 mm, the deformation of the side portion 6 at impact becomes uneven.

Therefore, owing to the thin parts 9, the weight of the side portion 6 can be reduced. As the buttressed parts 8 controls the deformation of the club head 1 at impact and as a result, excellent hit feeling and durability can be obtained. If the vertical buttressed part 8 is not continuous between the crown portion 4 and sole portion 5, at the terminal end thereof, the stress at impact tends to concentrate and the durability of club head 1 decreases.

In the example shown in FIGS. 5-7, the side portion 6 is composed of only the vertical buttressed parts 8A and thin parts 9 therebetween. The vertical buttressed parts 8A are the toe-side vertical buttressed part 8At, heel-side vertical buttressed part 8Ah, and two vertical buttressed part 8Ac therebetween. The thin parts 9 are three thin parts 9 therebetween. In FIGS. 6 and 7, the buttressed parts 8At, 8Ac and 8Ah are indicated in gray.

In the example shown in FIGS. 9-11, the side portion 6 is provided with the vertical buttressed parts 8A in the same way as explained above, namely, the buttressed parts 8At, 8Ah and 8Ac. The side portion 6 in this example is further provided between the vertical buttressed parts 8A with transversal buttressed parts 8B. In FIGS. 10 and 11, the buttressed parts 8B, 8At, 8Ac and 8Ah are indicated in gray.

The transversal buttressed parts 8B each extend along the upper edge 6U of the side portion 6 from one of the adjacent two vertical buttressed parts 8A to the other. Thus, the buttressed part 8 as a whole has a part which extends along the upper edge 6U of the side portion 6 continuously from the toe to the heel through the back face. As a result, the thin parts 9 in this example are each framed in by two vertical buttressed parts 8A and one transversal buttressed part 8B therebetween. Therefore, the side portion 6 is reinforced by such framed structure and strength and rigidity of the upper edge zone thereof can be increased to improve the durability and also hit feeling.

Furthermore, in the case of the four-piece structure, at the time of welding the crown member 1C to the upper edge 6U of the side portion 6, the buttressed part 8 can effectively prevent burn-through, and the durability of the weld junction can be improved.

In the vertical direction, the transversal buttressed part 8B extends from the upper edge 6U towards the sole portion 5. As to the size of the transversal buttressed part 8B, when measured in the vertical direction along the side portion 6, the height W is preferably at least 2 mm, more preferably not less than 3 mm, but preferably at most 10 mm, more preferably not more than 9 mm, still more preferably not more than 8 mm. If less than 2 mm, it becomes difficult to control the deformation. If more than 10 mm, the hit feeling becomes hard, and the height of the center of gravity of the head tend to increase.

In the example shown in FIGS. 9-11, the height W of each transversal buttressed part 8B is constant in the transversal direction, and further all the transversal buttressed parts 8B have the same heights w. But it may be varied as far as the height W is within the range of from 2 to 10 mm.

Figure 12:
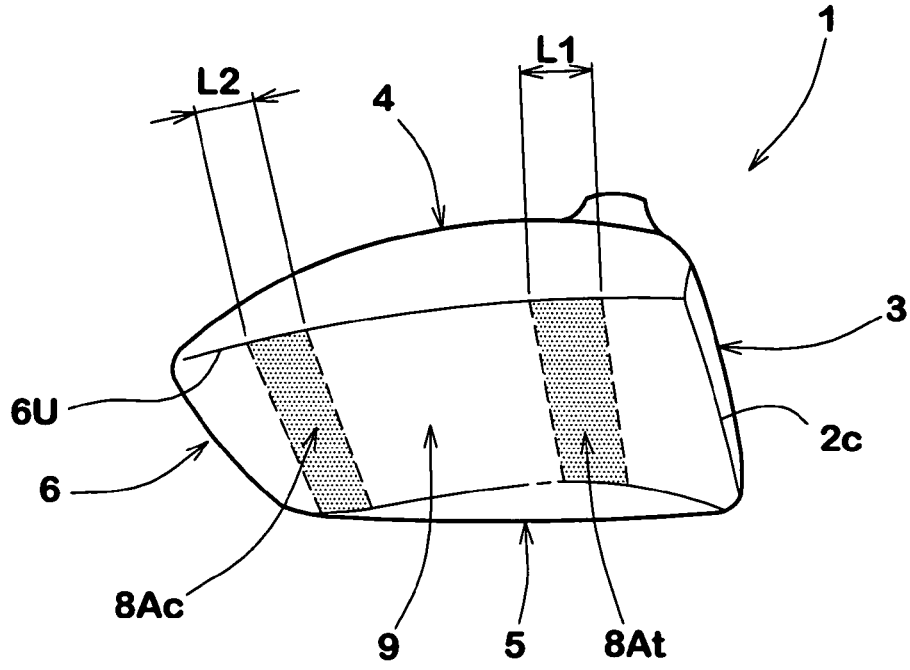
FIG. 12 is a left side view of a further example of the side portion.
Figure 13:
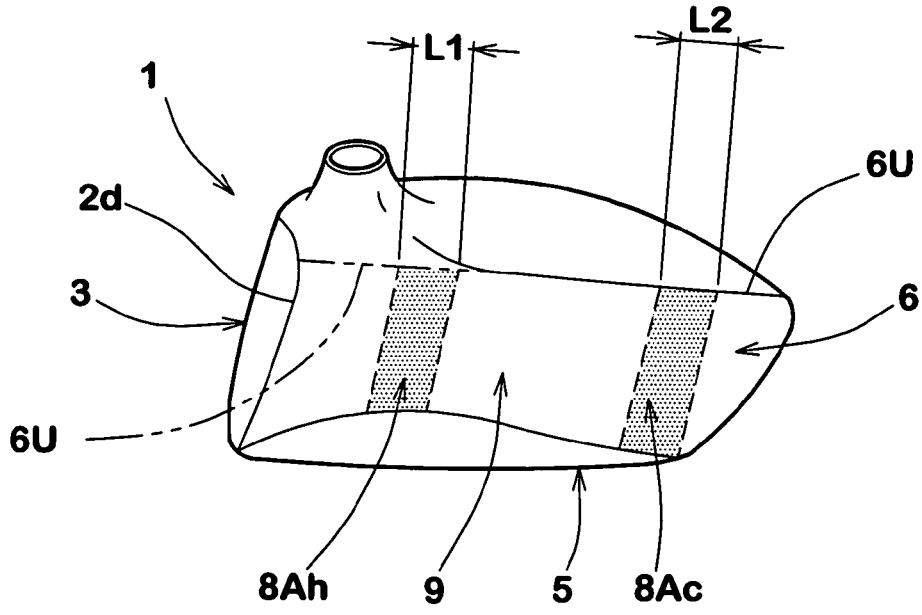
FIG. 13 is a right side view thereof.

FIGS. 12 and 13 shows a modification of the example shown in FIGS. 6 and 7, wherein the toe-side vertical buttressed part 8At and heel-side vertical buttressed part 8Ah are not extended to the edge 2*c* and edge 2*d*, respectively, and the length L1 is almost same as the length L2.

Comparative Tests

Wood-type heads having the following structures (type A and type B) were made and tested for durability and hit feeling and the sweet spot height was measured.

Type A: Two-piece structure of a face member and head main body as shown FIG. 4. The head main body was formed by casting a titanium alloy Ti-6Al-4V. The face member was formed by forging the same titanium alloy Ti-6Al-4V so that the thickness became 3.2 mm in a central region around the sweet spot and 2.5 mm in the peripheral region. The two members were welded using CO2 laser. The head volume was 460 cc.

Type B: Four-piece structure of a face member, crown member, sole-and-side member and hosel member as shown in FIG. 8. The face member was formed by forging a titanium alloy Ti-15V-3Cr-3Al-3Sn so that the thickness became 3.2 mm in a central region around the sweet spot and 2.5 mm in the peripheral region. The other members were formed by forging pure titanium. The four members were welded using CO2 laser. The head volume was 460 cc, Other specifications of the head are shown in Table 1.

Sweet Spot Height:

The sweet spot height of each head was measured. The sweet spot SS is defined as a point at which a straight line drawn normally to the club face 2 from the center of gravity G intersects the club face 2. The sweet spot height is defined as the vertical height measured from the horizontal plane to the sweet spot SS in the standard state of the head which is set on the horizontal plane satisfying its lie angle and loft angle as explained above.

Durability Test:

The club head was attached to a FRP shaft to make a 45-inch wood club, and the golf club was mounted on a swing robot. The head struck golf balls (DDH TOUR SPECIAL) 5000 times at a head speed of 54 meter/second, and thereafter the club face was checked for deformation and/or damage. The results are ranked A, B and C as indicated in Table 1, wherein A: no damage B: broken between 3000 hits and 5000 hits C: broken under 3000 hits Hit Feeling Test:

Each of the wood clubs was evaluated by ten testers (professional golfers and top-level amateur golfers) each having a handicap of 5 or less, wherein each tester hit the golf balls five times. The test results are shown in Table 1 together with the most impression on each club, wherein "A" denotes that seven or more testers evaluated the hit feeling as good, "B" denotes that four to six testers evaluated the hit feeling as good, and "c" denotes that three or lass testers evaluated the hit feeling as good.

From the test results, it was conformed that the durability, hit feeling and the center-of-gravity height can be improved.

As explained above, the present invention is suitably applied to wood-type golf club heads, but it is also possible to apply to various hollow golf club heads inclusive of all-metal heads and Metal/FRP hybrid heads. If the ball hit sound is not problematic, a FRP material can be used in the crown portion.

TABLE 1

| Club head | Ref. 1 | Ref. 2 | Ref. 3 | Ref. 4 | Ex. 1 | Ex. 2 | Ex. 3 | Ex. 4 | Ex. 5 | Ex. 6 | Ex. 7 | Ex. 8 |
|---|---|---|---|---|---|---|---|---|---|---|---|---|
| Head type | A | A | A | A | A | A | A | A | A | B | B | A |
| Crown portion (4) | | | | | | | | | | | | |
| Thickness tc (mm) | 0.7 | 0.7 | 0.3 | 0.7 | 0.7 | 0.7 | 0.7 | 0.5 | 0.7 | 0.7 | 0.7 | 0.7 |
| Sole portion (5) | | | | | | | | | | | | |
| Thickness (mm) | 2.2 | 1.7 | 2.1 | 1.0 | 1.3 | 1.5 | 1.7 | 1.9 | 1.1 | 1.3 | 1.5 | 1.4 |
| Side portion (6) | | | | | | | | | | | | |
| Structure (FIG.) | 6-7 | 6-7 | 6-7 | 6-7 | 6-7 | 6-7 | 6-7 | 6-7 | 6-7 | 10-11 | 10-11 | 12-13 |
| Buttressed parts (8) | | | | | | | | | | | | |
| Thickness t1 (mm) | 0.5 | 0.75 | 0.92 | 1.2 | 1.2 | 0.9 | 0.7 | 0.9 | 0.9 | 1.2 | 0.9 | 1.2 |
| Vertical (8A) | | | | | | | | | | | | |
| Length L1 (mm) | 30 | 30 | 30 | 30 | 30 | 30 | 30 | 30 | 55 | 30 | 30 | 10 |
| Length L2 (mm) | 10 | 10 | 10 | 10 | 10 | 10 | 10 | 10 | 20 | 10 | 10 | 10 |
| Transversal (8B) | | | | | | | | | | | | |
| Height W (mm) | — | — | — | — | — | — | — | — | — | 5 | 5 | — |
| Thin parts (9) | | | | | | | | | | | | |
| Thickness t2 (mm) | 0.4 | 0.25 | 0.4 | 1.1 | 0.5 | 0.4 | 0.35 | 0.4 | 0.4 | 0.5 | 0.4 | 0.5 |
| Sweet spot height (mm) | 33.0 | 34.0 | 33.2 | 36.0 | 35.2 | 34.8 | 34.2 | 33.7 | 35.6 | 35.3 | 34.7 | 35.0 |
| Durability | C | C | C | A | A | A | A | A | A | A | A | B |
| Hit feeling | C | C | C | C | A | A | A | A | A | A | A | B |
| Impression | too soft | too soft | too soft | hard | — | — | — | — | — | — | — | — |

The invention claimed is:

1. A hollow golf club head comprising a face portion having a club face, a crown portion, a sole portion, and a side portion between the crown portion and sole portion, extending from a toe-side edge to a heel-side edge of the club face through a back face of the head, wherein the crown portion is provided with a thickness-reduced part having a thickness of from 0.4 to 0.7 mm, and the side portion is provided with at least two vertical buttressed parts each extending from the crown portion to the sole portion and having a thickness of more than 0.6 mm but not more than 2.0 mm, and a thin part formed between the vertical buttressed parts and having a thickness of not more than 0.6 mm, wherein the vertical buttressed parts include:

a toe-side vertical buttressed part extending along the toe-side edge of the face portion;

a heel-side vertical buttressed part extending along the heel-side edge of the face portion; and at least one in-between vertical buttressed part therebetween, wherein the toe-side and heel-side vertical buttressed parts have a length of 5 to 50 mm along the upper edge of the side portion, and the in-between vertical buttressed part has a length of 1 to 10 mm along the upper edge of the side portion.

2. The hollow golf club head according to claim 1, wherein the difference of the thickness of the thin part from the thickness of at least one of the adjacent vertical buttressed parts is not less than 0.2 mm.

3. The hollow golf club head according to claim 2, wherein the thin part extends from the crown portion to the sole portion.

4. The hollow golf club head according to claim 1, wherein the thin part extends from the crown portion to the sole portion.

5. A hollow golf club head comprising a face portion having a club face, a crown portion, a sole portion, and a side portion between the crown portion and sole portion, extending from a toe-side edge to a heel-side edge of the club face through a back face of the head, wherein the crown portion is provided with a thickness-reduced part having a thickness of from 0.4 to 0.7 mm, and the side portion is provided with at least two vertical buttressed parts each extending from the crown portion to the sole portion and having a thickness of more than 0.6 mm but not more than 2.0 mm, and a thin part formed between the vertical buttressed parts and having a thickness of not more than 0.6 mm, the side portion is further provided with a transversal buttressed part having a thickness of more than 0.6 mm but not more than 2.0 mm and extending between the vertical buttressed parts along the upper edge of side portion, whereby the thin part is framed in by the transversal buttressed part and the vertical buttressed parts.

* * * * *